US006139411A

United States Patent [19]

Everts et al.

[11] Patent Number: 6,139,411

[45] Date of Patent: Oct. 31, 2000

[54] DISC SANDER

[75] Inventors: Robert G. Everts, Chandler; Kenneth M. Brazell, Phoenix; Kenneth J. Weger, Tempe, all of Ariz.

[73] Assignee: Ryobi North America, Inc., Anderson, S.C.

[21] Appl. No.: 09/134,017

[22] Filed: Aug. 14, 1998

Related U.S. Application Data

[63] Continuation-in-part of application No. 09/034,098, Mar. 3, 1998, abandoned.

[51] Int. Cl.[7] ..... B24B 27/08

[52] U.S. Cl. ..... 451/359; 451/453; 451/456; 451/451

[58] Field of Search ..... 451/359, 453, 451/456, 451, 259, 414, 454

[56] References Cited

U.S. PATENT DOCUMENTS

| | | |
|---|---|---|
| 1,101,171 | 6/1914 | Fischer . |
| 2,236,232 | 3/1941 | Brescka et al. . |
| 2,654,190 | 10/1953 | Mitchell . |
| 2,814,171 | 11/1957 | Bogart . |
| 3,394,500 | 7/1968 | Lill et al. . |
| 3,882,644 | 5/1975 | Cusumano . |
| 3,974,598 | 8/1976 | Guidry . |
| 4,058,937 | 11/1977 | Mitchell . |
| 4,228,618 | 10/1980 | Jensen . |
| 4,287,685 | 9/1981 | Marton . |
| 4,328,645 | 5/1982 | Sauer . |
| 4,782,632 | 11/1988 | Matechuk . |
| 5,099,616 | 3/1992 | Hampl et al. . |
| 5,168,656 | 12/1992 | Jolly et al. . |
| 5,199,220 | 4/1993 | Steiner et al. . |
| 5,231,801 | 8/1993 | Svetlik et al. . |
| 5,237,781 | 8/1993 | Demetrius . |
| 5,411,433 | 5/1995 | Keller . |

*Primary Examiner*—Timothy V. Eley
*Assistant Examiner*—Willie Berry, Jr.
*Attorney, Agent, or Firm*—Brooks & Kushman P.C.

[57] ABSTRACT

A disc sander having a scroll type vane pump embodied in a shroud enclosing the back side of a sanding disc. The inlet ports of the pump are coupled by a manifold to a location adjacent to the front face of the sanding disc at a location where the sanding dust and debris are generated. A tortious serpentine path is provided about the periphery of the pump housing which reduces pump noise and increases pump efficiency. The fins of the vane pump are provided on the back side of the sanding disc.

23 Claims, 4 Drawing Sheets

DISC SANDER

RELATED CASES

This application is a continuation-in-part of Ser. No. 09/034,098 filed Mar. 3, 1998 now abandoned.

TECHNICAL FIELD

The invention is related to the field of sanders and in particular to a disc sander embodying a vacuum system for the removal and storage of dust and debris generated during the sanding operation:

BACKGROUND ART

The dust and debris generated by sanding operations using a disc sander has always been a health and safety problem. In the past, separate vacuum systems have been deployed in the vicinity of the disc sander to capture and remove the sanding dust and debris from the immediate region of the sanding disc. For the most part, these vacuum systems were effective but required a separate motor to drive the vacuum system. Further, these vacuum systems emitted a whining sound which was irritating to the operator.

To eliminate the need for a separate vacuum system the prior art taught the use of a vacuum pump disposed on the reverse side of the sanding disc and utilized the same motor used to rotate the sanding disc. In particular, Bogart in U.S. Pat. No. 2,814,171 teaches a sanding machine in which the sanding dust and debris are drawn through apertures or holes provided through a porous abrading member and a porous mounting disc by a vacuum pump located behind the mounting disc. The impeller of the vacuum pump is attached to the shaft of the mounting disc and is commonly driven therewith.

In an alternate arrangement taught by Demetrius in U.S. Pat. No. 5,237,781 an impeller is attached to the output shaft of the motor and sucks air from about the periphery of the sanding disc to capture and remove the dust and debris generated during a sanding operation.

The invention disclosed herein is a sanding disc machine having a self-contained vacuum system which is relatively quiet and is highly effective in capture and removal the dust and debris from the sanding operation.

SUMMARY OF THE INVENTION

A disc sander having a base, an electric motor attached to the sanding disc attached to the shaft of the electric motor, and a shroud attached to the base between the sanding disc and the motor. The shroud embodies a scroll type baffle which in conjunction with the back face of the sanding disc form a housing for a vane type vacuum pump. Fins provided on the back face of the sanding disc produce an air flow from the inlet ports to an exhaust nozzle. An inlet manifold provided along the front face of the sanding disc is connected to the input ports of the pump housing from where they are expelled by the pump into a collector bag.

One objective of the disc sander is that the sanding dust generated by a sanding operation is drawn away from the dirty side of the sanding disc where the dust is generated.

Another object of the invention is the use of an input manifold to conduct the sanding dust from the front side of the sanding disc into a vacuum pump disposed on the opposite side.

Another objective of the invention is the use of a scroll type vane pump housing for increased pumping efficiency.

Still another objective of the invention is to embody a tortuous serpentine path between the scroll type baffle and the sanding disc to reduce the escape of the dust about the periphery of the pump housing.

Another object of the pump is that it is relatively quiet.

Another object of the invention is the elimination of a separate vacuum system for the removal and capture of the generated sawdust.

These and other objects of the invention will become more apparent from a detailed reading of the specification in conjunction with the drawings.

DETAILED DESCRIPTION OF THE BEST MODE

Figure 1:
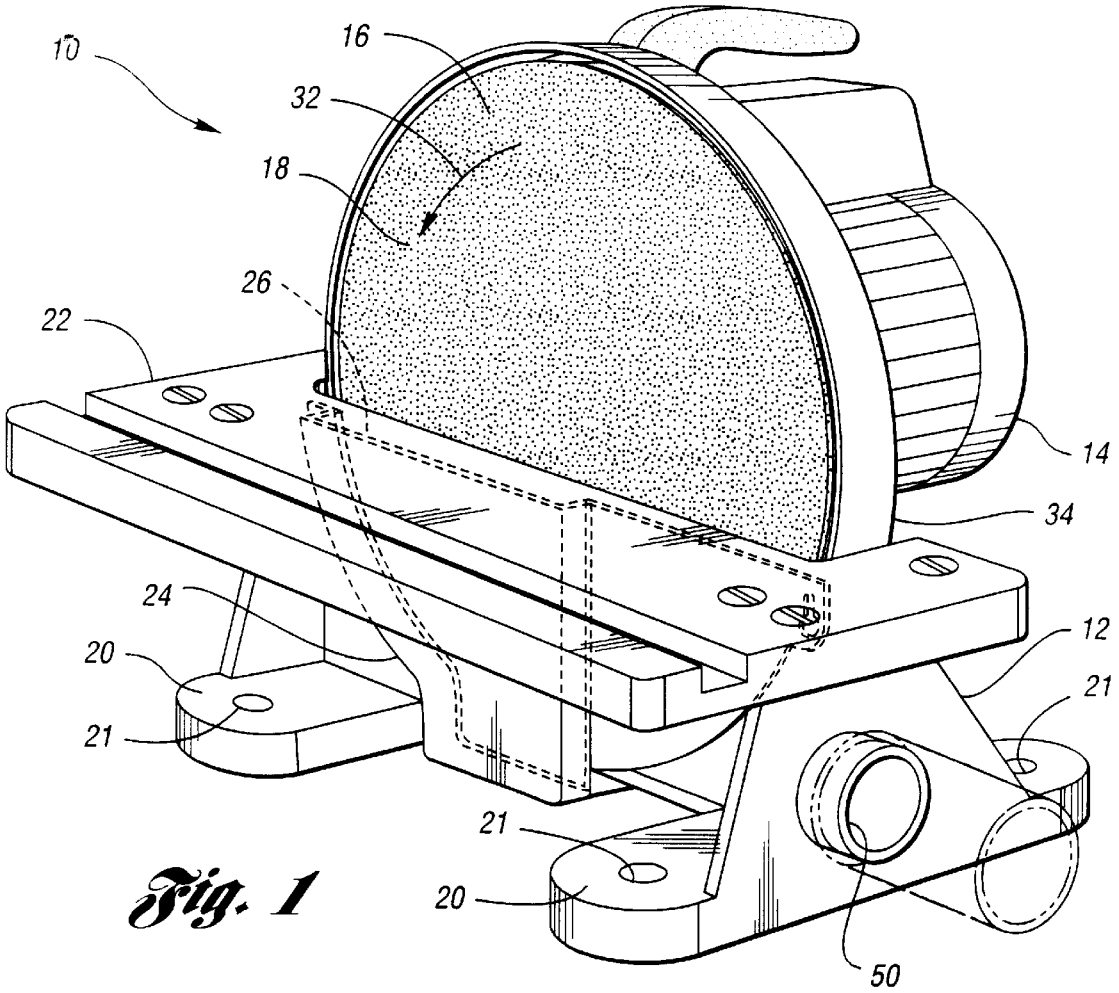
FIG. 1 is a perspective of the disc sander according to the invention.
Figure 2:
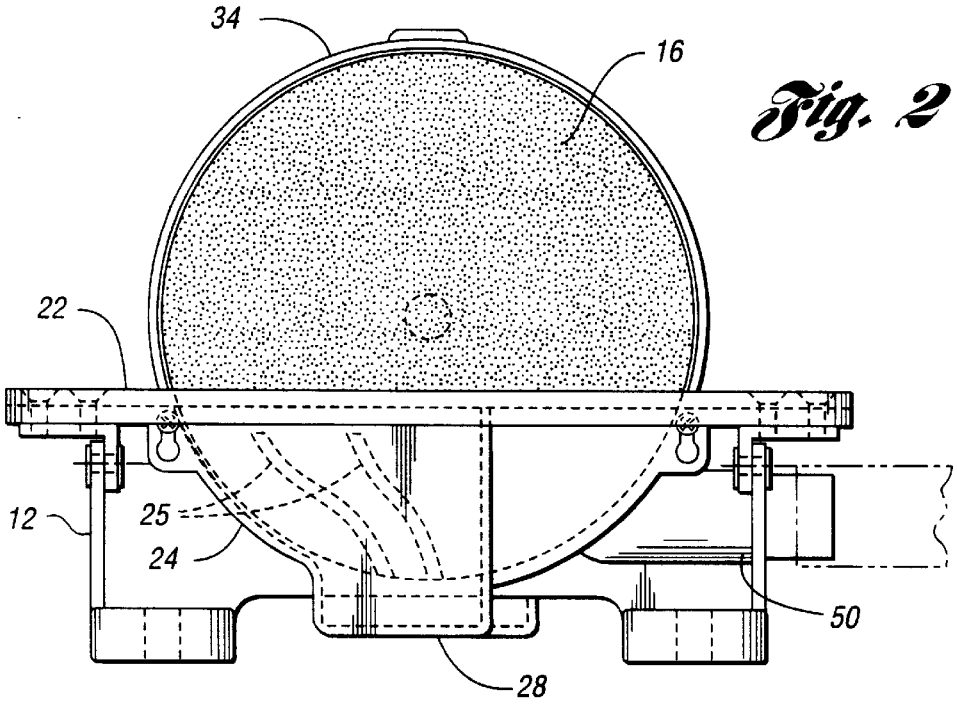
FIG. 2 is a front view of the disc sander.
Figure 3:
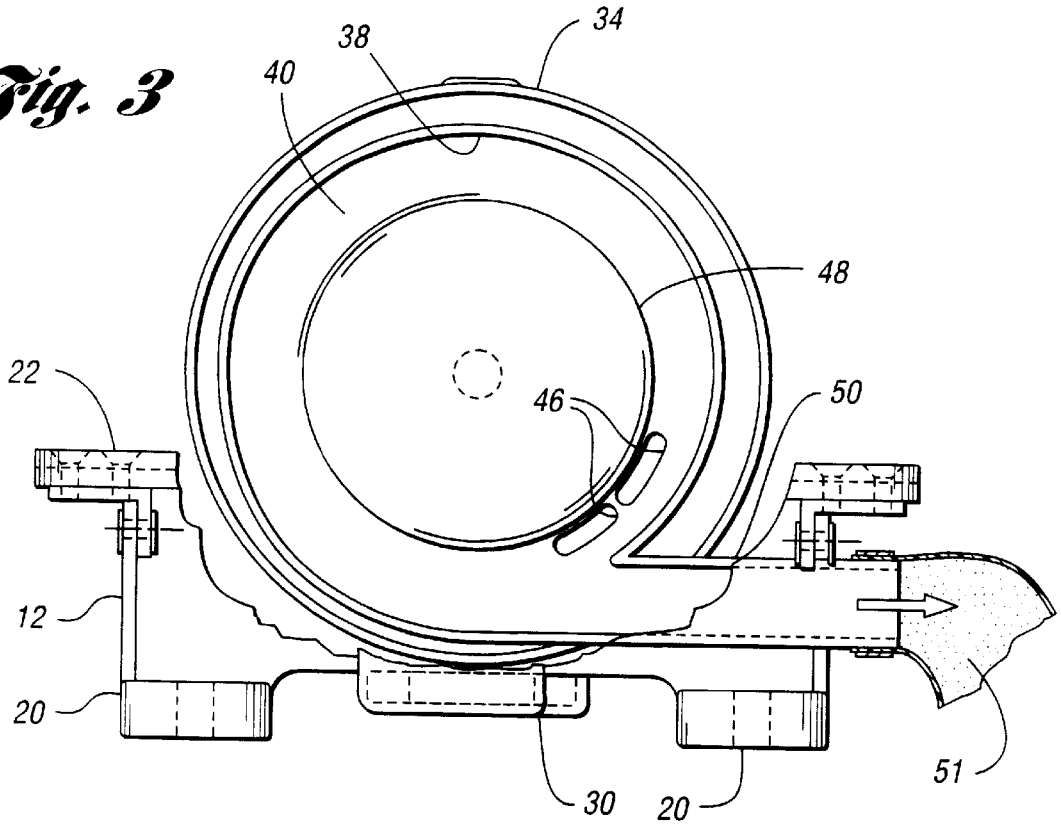
FIG. 3 is a rear view of the disc sander.
Figure 5:
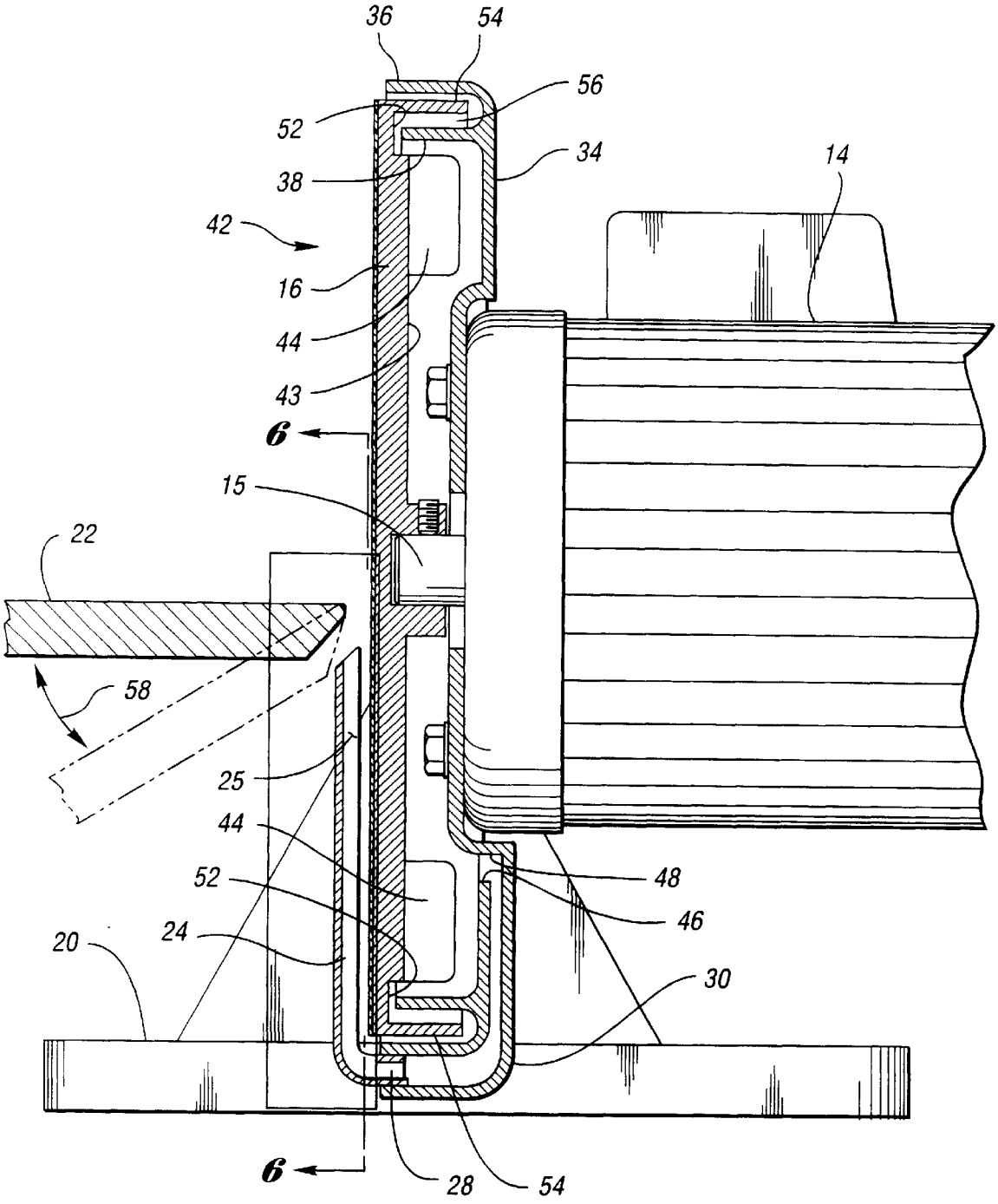
FIG. 5 is a cross sectional side view of the disc sander.

The details of the bench mounted disc sander 10 embodying an integral vacuum system is shown on FIG. 1. The disc sander 10 has a base 12 to which is attached an electric motor 14. A sanding disc 16 is attached to the shaft 15 of the electric motor 14 as shown in FIG. 5 and has a sanding pad 18 attached to its surface on the side opposite the motor 14. The sanding pad 18 may be a self-adhesive sanding pad or may be attached to the sanding disc using any method commonly known in the art. The base 12 further has a pair of mounting pads 20 which are adapted to affix the disc sander 10 to a work table or work bench (not shown). Bolt holes 21 are provided in the mounting pads 20 for the permanent mounting the disc sander using bolts, screws or other types of fasteners. The disc sander 10 also includes a work support table 22 pivotably attachable to the base 12. A vacuum inlet manifold 24 is also attached to the base 12 and disposed adjacent to the working side of the sanding disc 16 which is the side opposite the motor 14.

Figure 6:
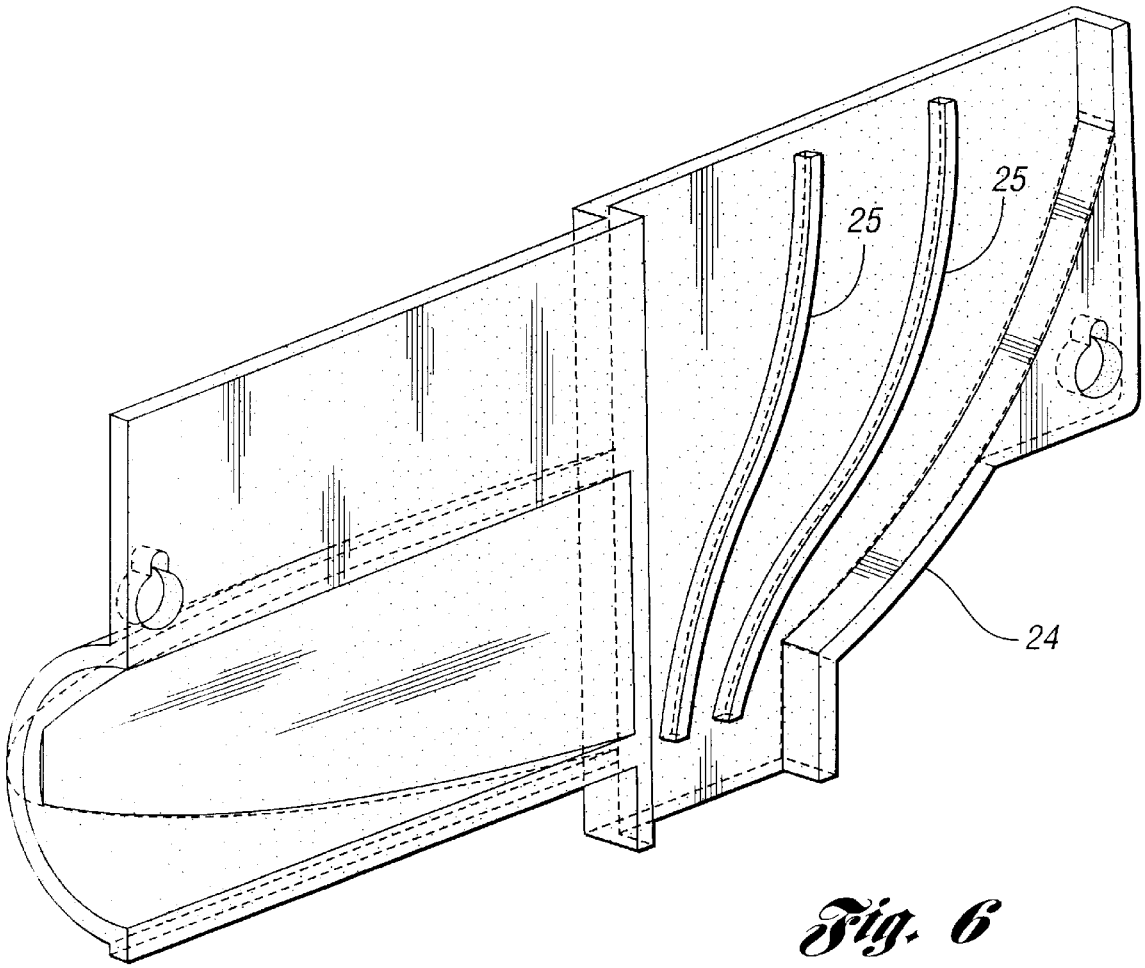
FIG. 6 is a cross-sectional view of the vacuum intake manifold taken along section line 6—6 in FIG. 5.

The vacuum inlet manifold 24 has at least two internal fins 25 shown in phantom to uniformly distribute the air flow across the length of the inlet of the vacuum inlet manifold. The details of the external fins 25 are more clearly shown on FIG. 6 which is a cross-sectional view taken along cross-section line 6—6 of FIG. 5.

The work support table is pivotable relative to the sanding disc 16 as indicated by the double headed arrow 58 as shown on FIG. 5.

The inlet manifold 24 has an inlet 26 which extends substantially parallel to the surface of the sanding disc 16 and an exit port 28 as shown on FIG. 5. The exit port connects to a connecting manifold 30 provided in the mount 12. Preferably, the inlet 26 is in the form of an elongated rectangle, as shown in FIG. 1 and extends in a direction parallel to and below the work table 22 such that the sanding dust and debris are directed towards the inlet 26 by the rotation of the sanding disc 16. For example, if the sanding disc 16 is rotating in a counterclockwise direction, as indicated by arrow 32 in FIG. 1, the inlet would be located along the left side of the sanding disc as viewed in FIG. 1. Conversely, if the sanding disc 16 rotates in a clockwise direction the inlet 26 to the inlet manifold would be located at the right side of the sanding disc.

The base 12 includes a shroud 34 disposed between the sanding disc 16 and the motor 14. The shroud 34 may be formed integral with the base 14 or may be a separate element attached to the base. The shroud 34 has an annular lip 36 circumscribing the sanding disc 16 about its periphery. The shroud 34 also has a scroll shaped rib or baffle 38 which defines a recessed nautilus shell type volute 40 which constitutes a first part of a pump housing for a vane type vacuum pump 42. The open face of volute 40 is closed by the back face 43 of the sanding disc 16 which is placed in close proximity thereto. A plurality of generally radical fins 44 are provided symmetrically on the back face of the sanding disc 16 as shown in FIG. 5 and extend into the recessed volute 40.

Figure 4:
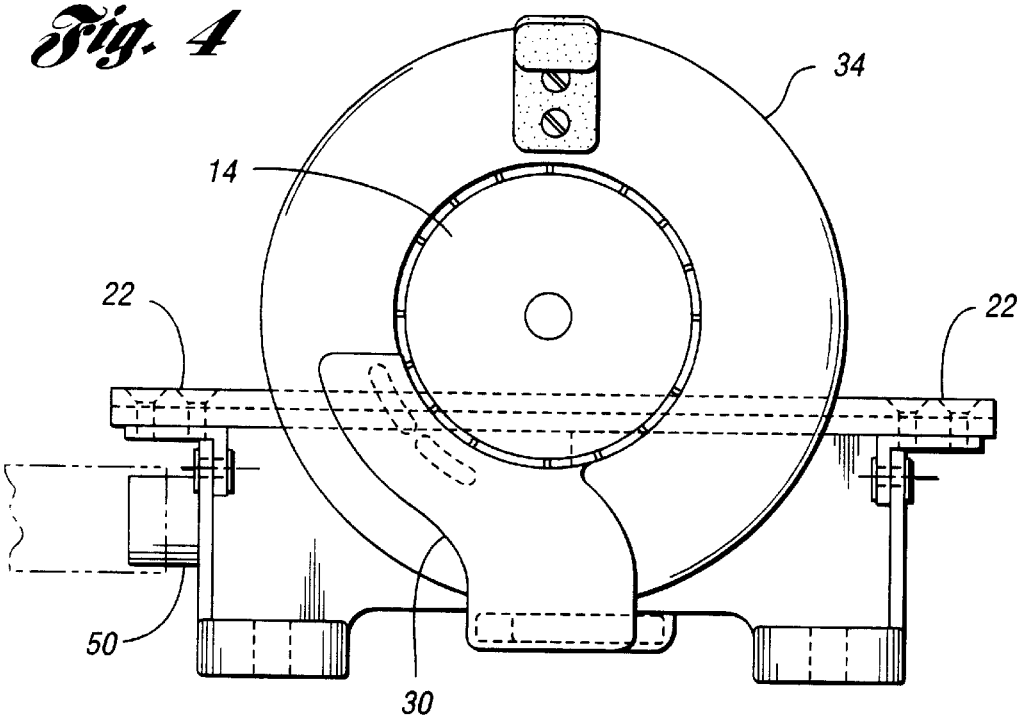
FIG. 4 is a front view of the disc sander with the intake manifold and sanding disc removed.

The connecting manifold 30 extends from the inlet manifold 24 to one or more inlet ports 46 to the recessed volute 40. The connecting manifold may be formed by ribs cast onto the back side of the shroud and enclosed with a cover plate attached thereto. The inlet ports 46 as shown in FIG. 4 are provided as close as possible to the inner annular surface 48 of the recessed volute 40 and a dust outlet nozzle 50 is provided through the wall of the shroud 34 connecting the inside of the vacuum pump 42 to a collector bag 51 external to the disc sander.

An annular recess 52 is provided in the back face of the sanding disc 16 providing clearance for the outer edges of the scroll shaped baffle 38. The sanding disc 16 also has an annular rim 54 which extends into the space 56 between the lip 36 and the scroll type baffle 38 provided in the shroud. The recess 52, annular rim 54 and annular lip 36 form a tortuous serpentine path about the periphery of the vacuum pump which significantly reduces the escape of dust and air about the periphery of the vacuum pump.

In operation, the rotation of the fins 44 in the recessed volute 40 draws air, dust and debris through the inlet ports 46 and expels the drawn in air, dust and debris through the exit nozzle 50 to the collector bag 51. Because the inlet ports 44 of the vacuum pump 40 are connected to the inlet 26 of the inlet manifold 24, the air flow produced by the vacuum pump will draw the dust and debris generated by a sanding operation away from the sanding disc and its immediate area making the vacuum system highly efficient in the capture and removal of the generated dust and debris.

The primary advantage of the disc sander mechanism is the placement of the inlet to the vacuum pump adjacent to the surface of the sanding disc in the immediate region where the sanding dust is generated.

Another advantage is that the resulting vacuum system is relatively noiseless compared to comparable vacuum systems.

The invention is not limited to the specific mechanical embodiment shown in the drawings and described in the specification. It is acknowledged that those skilled in the art may make changes and improvements to the disclosed disc sander within the scope of the invention as set forth in the appended claims.

What is claimed is:

1. A disc sander comprising:

a base having a shroud, said shroud including a scroll type baffle forming a fan housing, the fan housing having at least one inlet port and an exit nozzle;

an electric motor attached to said base, said electric motor having an output shaft extending normal to said shroud;

a sanding disc attached to said shaft adjacent to said shroud, said sanding disc having a plurality of spaced apart fins extending into said fan housing and forming therewith a vane type pump; and an inlet manifold having an inlet disposed adjacent to a surface of said sanding disc on the side opposite said shroud and an outlet connected to said at least one inlet port to said fan housing the inlet manifold conducting an air flow from the region in front of the sanding disc on the side opposite the shroud into the fan housing.

2. The disc sander of claim 1 wherein said shroud has an annular lip circumscribing said sanding disc and said sanding disc has an annular rim received in a space between said annular lip and said scroll type baffle to form a tortuous serpentine air path about the periphery of said fan housing.

3. The disc sander of claim 2 wherein said sanding disc has an annular recesses in which a portion of said scroll type baffle is received.

4. The disc sander of claim 1 wherein said inlet of said inlet manifold is an elongated rectangle having its longer sides extending parallel to the surface of the sanding disc.

5. The disc sander of claim 4 wherein said inlet manifold has at least external fin to more uniformly distribute the air flow into said inlet of said inlet manifold.

6. The disc sander of claim 5 wherein said inlet manifold has two internal fins.

7. The sanding disc of claim 1 wherein said shroud includes a connecting manifold having one end connected to said at least one inlet port and an opposite end connectable to said outlet of said inlet manifold.

8. The disc sander of claim 7 wherein said rectangular inlet is disposed in the region between said sanding disc and said work support table.

9. The disc sander of claim 8 further including a work support table attachable to said base adjacent to said sanding disc.

10. The sanding disc of claim 1 further including a work support table attached to said mount and disposed adjacent to said sanding disc on the side opposite said motor, said work support table spaced at a predetermined distance from said sanding disc.

11. The disc sander of claim 10 wherein said work support table is pivotable relative to said sanding disc.

12. The disc sander of claim 11 wherein said base and said shroud are an integral member.

13. The disc sander of claim 1 wherein said base has at least one pair of mounting feet for supporting said disc sander on a work table.

14. A disc sander comprising:

a base having at least a pair of mounting feet;

a shroud attached to said base, said shroud having an annular lip;

a motor having an output shaft said motor attached to said shroud;

a sanding disc attached to said shaft of said motor;

said sanding disc circumscribed by said annular lip;

a scroll type baffle attached to said shroud on the side facing said sanding disc, said scroll type shroud and said sanding disc forming a pump housing;

at least one inlet port for providing air to said pump housing;

a plurality of spaced apart radial fins attached to said sanding disc and rotatable therewith, said plurality of radial fins extending into said pump housing;

a manifold having an inlet provided adjacent to said sanding disc on the side opposite said motor and an outlet connected to said at least one inlet port to said pump housing the manifold conducting an air flow from the region in front of the sanding disc on the side opposite the motor into the fan housing; and an outlet nozzle for said pump housing.

15. The disc sander of claim 14 further including means for providing a tortuous sinusoidal air path between said sanding disc, and said shroud about the periphery of said pump housing to reduce air loss from the pump housing between the sanding disc and the periphery of said shroud.

16. The disc sander of claim 15 wherein said means for providing includes:

an annular recess provided in said sanding disc receiving a portion of said scroll type baffle; and an annular rim provided on said sanding disc received in the space between said annular lip and said scroll type baffle.

17. The disc sander of claim 16 wherein said elongated opening is disposed relative to said sanding disc such that the rotation of said sanding disc directs the generated dust and debris towards said elongated opening.

18. The disc sander of claim 15 wherein said inlet of said manifold is an elongated opening extending along the surface of said sanding disc.

19. The disc sander of claim 14 wherein said manifold comprises:

an inlet manifold attached to said shroud adjacent to said sand disc on the side opposite said motor said inlet manifold having an inlet adjacent to the surface of said sanding disc on the side opposite said shroud and an outlet; and a connecting manifold attached to said shroud having an inlet connected to said outlet of said inlet manifold and terminating in said inlet ports to said pump housing.

20. The disc sander of claim 19 wherein said inlet manifold further includes at least one internal fin to uniformly distribute the air flow across the sanding disc into said inlet manifold.

21. The disc sander of claim 20 wherein said at least one internal fin has two internal fins.

22. The disc sander of claim 19 wherein said work support table is pivotably attached to said base.

23. The disc sander of claim 19 wherein said work support table is spaced from disc sander and said inlet is disposed in the region between said sanding disc and said work support table.

* * * * *